US010249451B2

(12) United States Patent
Diao

(10) Patent No.: US 10,249,451 B2
(45) Date of Patent: Apr. 2, 2019

(54) PERMANENT MAGNET DRIVE ON-LOAD TAP-CHANGING SWITCH

(71) Applicant: Junqi Diao, Jinan (CN)

(72) Inventor: Junqi Diao, Jinan (CN)

( * ) Notice: Subject to any disclaimer, the term of this patent is extended or adjusted under 35 U.S.C. 154(b) by 141 days.

(21) Appl. No.: 15/540,772

(22) PCT Filed: Jan. 28, 2015

(86) PCT No.: PCT/CN2015/071679
§ 371 (c)(1),
(2) Date: Jun. 29, 2017

(87) PCT Pub. No.: WO2016/106917
PCT Pub. Date: Jul. 7, 2016

(65) Prior Publication Data

US 2017/0352502 A1 Dec. 7, 2017

(30) Foreign Application Priority Data

Dec. 29, 2014 (CN) ..... 2014 2 0848102 U

(51) Int. Cl.
*H01H 9/00* (2006.01)
*H01H 3/28* (2006.01)
(Continued)

(52) U.S. Cl.
CPC ..... *H01H 9/0016* (2013.01); *H01F 7/0242* (2013.01); *H01F 29/04* (2013.01);
(Continued)

(58) Field of Classification Search
CPC ... H01H 9/0005; H01H 9/0016; H01H 9/0027
See application file for complete search history.

(56) References Cited

U.S. PATENT DOCUMENTS 3,502,961 A * 3/1970 Matzl ..... H01F 29/04 323/343
4,496,805 A 1/1985 Duenke
(Continued)

FOREIGN PATENT DOCUMENTS

CN 2862287 Y 1/2007
CN 201359913 Y 12/2009
(Continued)

*Primary Examiner* — Fritz M Fleming
(74) *Attorney, Agent, or Firm* — Oliff PLC

(57) ABSTRACT

A permanent magnet drive on-load tap-changing switch including a changing switch circuit and a high-speed mechanism. The circuit includes structurally identical odd and even-numbered tap-changing switch circuits. The mechanism includes a traveling mechanism used for bearing a moving contactor, a moving magnet group connected with the traveling mechanism, and a fixed magnet group producing an attracting/repelling force with respect to the moving magnet group. The moving magnet group includes a first and second permanent magnet connected at homonymic magnetic poles. An exposed homonymic magnetic pole of the first and the second permanent magnet face directly the fixed magnet group. The fixed magnet group includes a rotating permanent magnet that rotates to change a force applied to the moving magnet group, allowing the moving contactors to either come into contact with or be separated from working contactors and dual-contact synchronous transition contactors.

5 Claims, 8 Drawing Sheets

(51) Int. Cl.

| | |
|---|---|
| ***H01H 36/00*** | (2006.01) |
| ***H01F 7/02*** | (2006.01) |
| ***H01F 29/04*** | (2006.01) |

(52) U.S. Cl.
CPC ..... *H01H 3/28* (2013.01); *H01H 9/0027* (2013.01); *H01H 36/0073* (2013.01)

(56) References Cited

U.S. PATENT DOCUMENTS

| | | | | |
|---|---|---|---|---|
| 6,060,669 | A * | 5/2000 | Dohnal ..... | H01H 9/0033 200/11 TC |
| 2018/0069492 | A1 * | 3/2018 | Bieringer ..... | H01H 9/0005 |

FOREIGN PATENT DOCUMENTS

| | | | |
|---|---|---|---|
| CN | 203150352 | U | 8/2013 |
| CN | 104517753 | A | 4/2015 |

* cited by examiner

PERMANENT MAGNET DRIVE ON-LOAD TAP-CHANGING SWITCH

TECHNICAL FIELD

The invention relates to an on-load tap-changing switch, particularly a permanent magnet drive on-load tap-changing switch.

BACKGROUND TECHNOLOGY

Transformers change the turns per effective coil on the high voltage side of transformers through the switching from one tap to another tap to realize voltage adjustment. The on-load tap-changing switch switches the load current via a changing switch, and the high-speed mechanism is the power source of changing switch. At present, the high-speed mechanism mainly adopts a spring energy-releasing unit, but the reliability of spring is poor, and once the main spring is damaged, the whole will break down; as the use time extends, the elasticity of spring will gradually become poor or the spring will break off, which will cause serious consequences.

CONTENT OF INVENTION

As for the aforesaid problems, the invention provides a permanent magnet drive on-load tap-changing switch using permanent magnet drive as high-speed mechanism, which operates fast and reliably and has a long service life.

In order to solve the aforesaid problems, the present invention adopts the following technical solutions: a permanent magnet drive on-load tap-changing switch, comprising a changing switch circuit and a high-speed mechanism, wherein the said changing switch circuit comprises an odd-numbered tap-changing circuit and an even-numbered tap-changing circuit that are structurally identical, wherein the tap-changing circuits are constituted by working contactors, and dual-contact synchronous transition contactors consisting of primary contactors and secondary contactors, and the working contactor is connected with the primary contactor by trigger transmitter and transition resistance, and a primary contactor of a tap-changing circuit is connected to the secondary contactor of another tap-changing circuit by a high-voltage thyristor, while the said trigger transmitter provides the high-voltage thyristor connected to the secondary contactor of the same tap-changing circuit with trigger current, wherein the said high-speed mechanism comprises a traveling mechanism used for bearing a moving contactor, a moving magnet group connected with the traveling mechanism, and a fixed magnet group producing an attracting force/repelling force with respect to the moving magnet group; wherein the said moving magnet group comprises a first permanent magnet and a second permanent magnet connected together at homonymic magnetic poles, an exposed homonymic magnetic pole of the first permanent magnet and that of the second permanent magnet face directly the fixed magnet group; wherein the said fixed magnet group comprises a rotating permanent magnet that rotates to change a force applied to the moving magnet group and thereby allowing the moving contactors to either come into contact with or be separated from working contactors and transition contactors.

Both sides of the said rotating permanent magnets are enveloped on the head poles of the first magnetic conductor and the second magnetic conductor, while the tail poles of the first magnetic conductor and the second magnetic conductor are respectively directly face to the first permanent magnet and the second permanent magnet.

The first magnetic conductor and the second magnetic conductor are arranged such that it is convenient to concentrate magnetic forces and better control the movement of moving magnet group.

The rotation of rotating permanent magnet is controlled to change the acting force of moving magnet group on the first magnetic conductor and the second magnetic conductor and consequently promote the moving magnet group to drive the movement of moving contactor in the travel mechanism, making the moving contactor contact with or separate from the working contactor and the dual-contact synchronous transition contactor and realizing the switching of odd-numbered and even-numbered taps. The poles of first permanent magnet and the second permanent magnet directly face to the fixed magnet group are homonymic magnetic poles, and the design enables the first permanent magnet and the second permanent magnet to be under an attracting force and a repelling force, respectively, and the directions are the same, while the force suffered by the moving magnet group is the resultant force of them, driving the movement of traveling mechanism.

In order to realize the accurate control by the rotating permanent magnet over the moving magnet group, the said first permanent magnet and the said second permanent magnet are located between the first magnetic conductor and the second magnetic conductor, and the four are parallel and level.

A permanent magnet drive on-load tap-changing switch, comprising a changing switch circuit and a high-speed mechanism, wherein the said changing switch circuit comprises an odd-numbered tap-changing circuit and an even-numbered tap-changing circuit that are structurally identical, wherein the tap-changing circuits are constituted by working contactors, and dual-contact synchronous transition contactors consisting of primary contactors and secondary contactors, and the working contactor is connected with the primary contactor by trigger transmitter and transition resistance, and a primary contactor of a tap-changing circuit is connected to the secondary contactor of another tap-changing circuit by a high-voltage thyristor, while the said trigger transmitter provides the high-voltage thyristor connected to the secondary contactor of the same tap-changing circuit with trigger current, wherein the said high-speed mechanism comprises a traveling mechanism used for bearing a moving contactor, a moving magnet group connected with the traveling mechanism, and a fixed magnet group producing an attracting force/repelling force with respect to the moving magnet group; wherein the said moving magnet group comprises a rotating permanent magnet, a first magnetic conductor and a second magnetic conductor respectively set on both sides of the rotating permanent magnet, and the poles of the first magnetic conductor and the second magnetic conductor far from the rotating permanent magnet are directly face to the fixed magnet group; wherein the said fixed magnet group comprises a first permanent magnet and a second permanent magnet respectively face to the first magnetic conductor and the second magnetic conductor, and the poles of both permanent magnets near the magnetic conductor are homonymic magnetic poles. The poles of both permanent magnets near the magnetic conductor are homonymic magnetic poles, and they control the rotating permanent magnet to make the magnetic conductors on both sides under an attracting force and a repelling force, respectively, in the same direction, while the force suffered by the moving magnet group is the resultant force of them, driving the movement of travel mechanism, making the moving contactor contact with or separate from the working contactor and the dual-contact synchronous transition contactor and realizing the switching of odd-numbered and even-numbered taps.

In order to realize the accurate control by the fixed magnet group over the moving magnet group, the said first magnetic conductor and the said second magnetic conductor are located between the first permanent magnet and the second permanent magnet, and the four are parallel and level.

The invention is structurally simple and highly reliable, utilizes, on the basis that like poles attract each other whereas unlike poles repel each other, the permanent magnets as the high-speed mechanism to drive the moving contactor to complete changing with working contactors and transition contactors thereof, extends the service life of the on-load tap-changing switch and has the value for widespread use.

Wherein, 1. First permanent magnet, 2. Travelling mechanism, 3. Second permanent magnet, 4. First magnetic conductor, 5. Rotating permanent magnet, 6. Second magnetic conductor, 7. Moving contactor, K1 and K2 are working contactors; R1 and R2 are transition resistors, k1, k1' and k2, k2' are dual-contact synchronous transition contactors, k1, k2 are primary contactors, k1', k2' are secondary contactors, TSCB1, TSCB2 are trigger transmitters, TSC1, TSC2 are high-voltage thyristors.

SPECIFIC EMBODIMENTS

Embodiment 1

Figure 1:
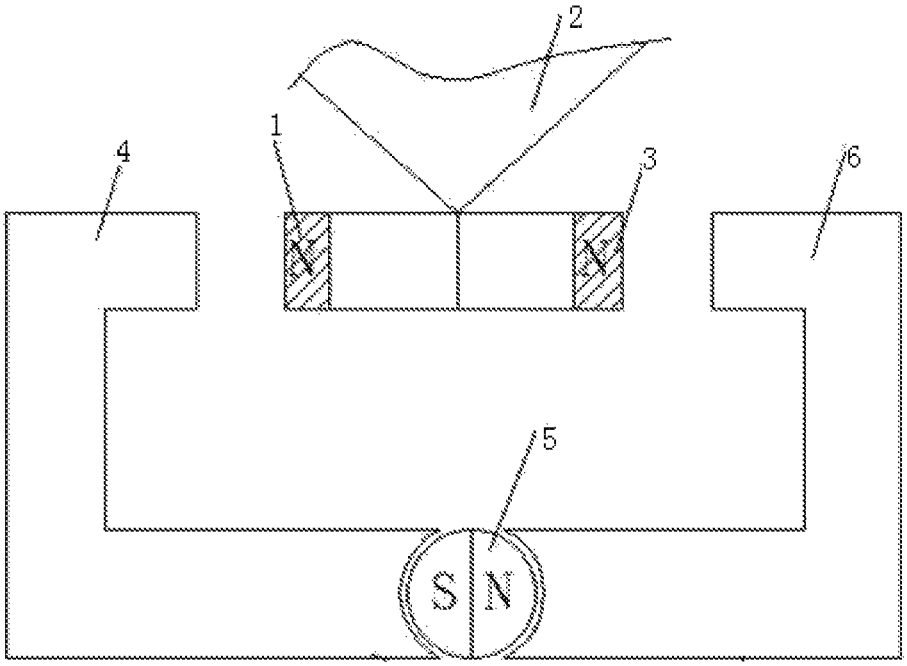
FIG. 1 is the structure diagram of high-speed mechanism in Embodiment 1.

A a permanent magnet drive on-load tap-changing switch, as shown in FIG. 1, comprising a changing switch circuit and a high-speed mechanism, wherein the said changing switch circuit comprises an odd-numbered tap-changing circuit and an even-numbered tap-changing circuit that are structurally identical, wherein the tap-changing circuits are constituted by working contactors K1/K2, and dual-contact synchronous transition contactors k1, k1'/k2, k2' consisting of primary contactors k1/k2 and secondary contactors k1'/k2', and the working contactor K1/K2 is connected with the primary contactor k1/k2 by trigger transmitter TSCB1/TSCB2 and transition resistance R1/R2, the primary contactor k1 of the odd-numbered tap-changing circuit is connected to the secondary contactor k2' of the even-numbered tap-changing circuit by the high-voltage thyristor TSC2; the primary contactor k2 of even-numbered tap-changing circuit is connected to the secondary contactor k1' of the odd-numbered tap-changing circuit by the high-voltage thyristor TSC1. The said trigger transmitter TSCB1 provides the high-voltage thyristor TSC1 with trigger current; the said trigger transmitter TSCB2 provides the high-voltage thyristor TSC2 with trigger current. Wherein the said high-speed mechanism comprises a traveling mechanism 2 used for bearing a moving contactor 7, a moving magnet group connected with the traveling mechanism 2, and a fixed magnet group producing an attracting force/repelling force with respect to the moving magnet group; wherein the said moving magnet group comprises a first permanent magnet 1 and a second permanent magnet 3 connected together at homonymic magnetic poles, an exposed homonymic magnetic pole of the first permanent magnet 1 and that of the second permanent magnet 3 face directly the fixed magnet group; wherein the said fixed magnet group comprises a rotating permanent magnet 5 that rotates to change a force applied to the moving magnet group and thereby allowing the moving contactors 7 to either come into contact with or be separated from working contactors K1/K2 and dual-contact synchronous transition contactors k1, k1'/k2, k2'. Both sides of the said rotating permanent magnets 5 are enveloped on the head poles of the first magnetic conductor 4 and the second magnetic conductor 6, while the tail poles of the first magnetic conductor 4 and the second magnetic conductor 6 are respectively directly face to the first permanent magnet 1 and the second permanent magnet 3. The said first permanent magnet 1 and the said second permanent magnet 3 are located between the first magnetic conductor 4 and the second magnetic conductor 6, and the four are parallel and level. In the Embodiment, the structure form of traveling mechanism 2 is not defined in any form as long as it can drive the moving contactor 7 to contact with or separate from the working contactors K1, K2 and the transition contactors k1, k2.

The first magnetic conductor 4 and the second magnetic conductor 6 are magnetized to the magnets of the corresponding magnetism; as the rotating permanent magnet 5 rotates, the attracting force and repelling force produced on the first permanent magnet 1 and the second permanent magnet 3 change, consequently controlling the movement of the moving magnet group, while the moving magnet group drives movement of the upper traveling mechanism 2, and the moving contactor 7 switches between the working contactors K1/K2 and the dual-contact synchronous transition contactors k1, k1'/k2, k2'.

Figure 3:
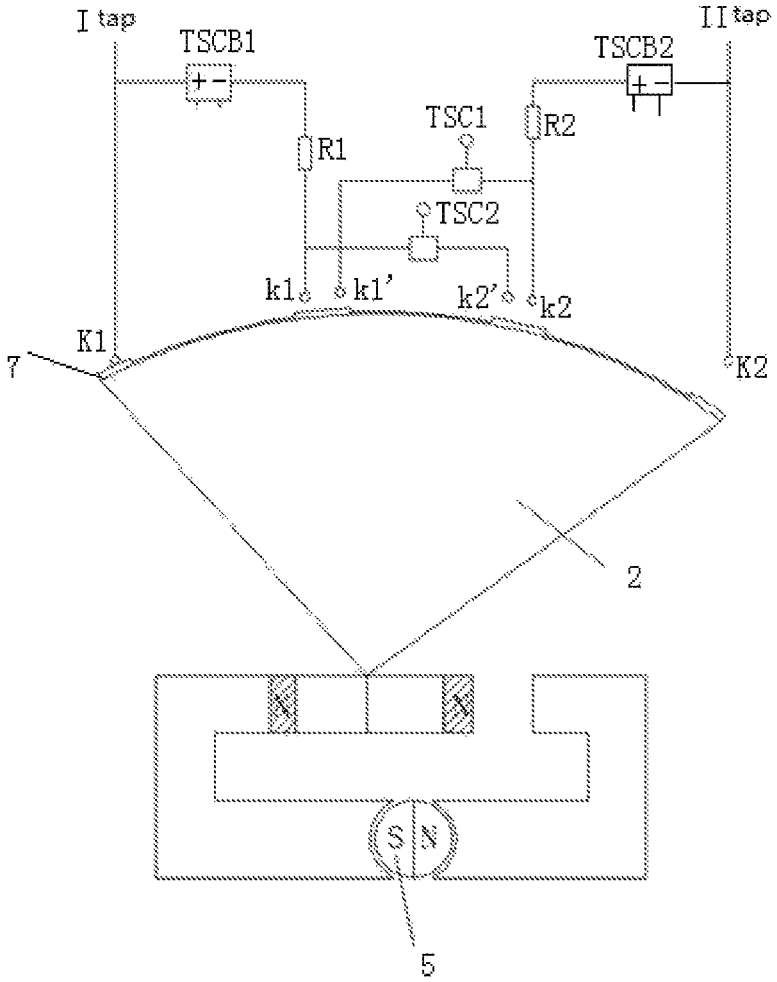
FIG. 3 is the schematic diagram of contacting of the moving contactor with the working contactor K1 in Embodiment 1.
Figure 4:
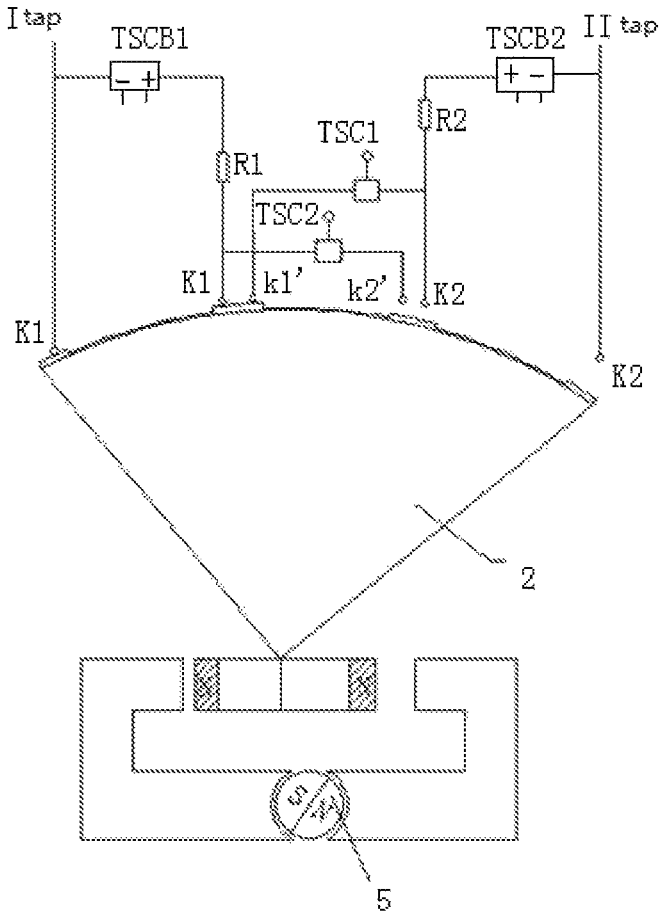
FIG. 4 is the schematic diagram of contacting of the moving contactor with the working contactor K1 and the dual-contact synchronous transition contactor k1, k1' in Embodiment 1.
Figure 5:
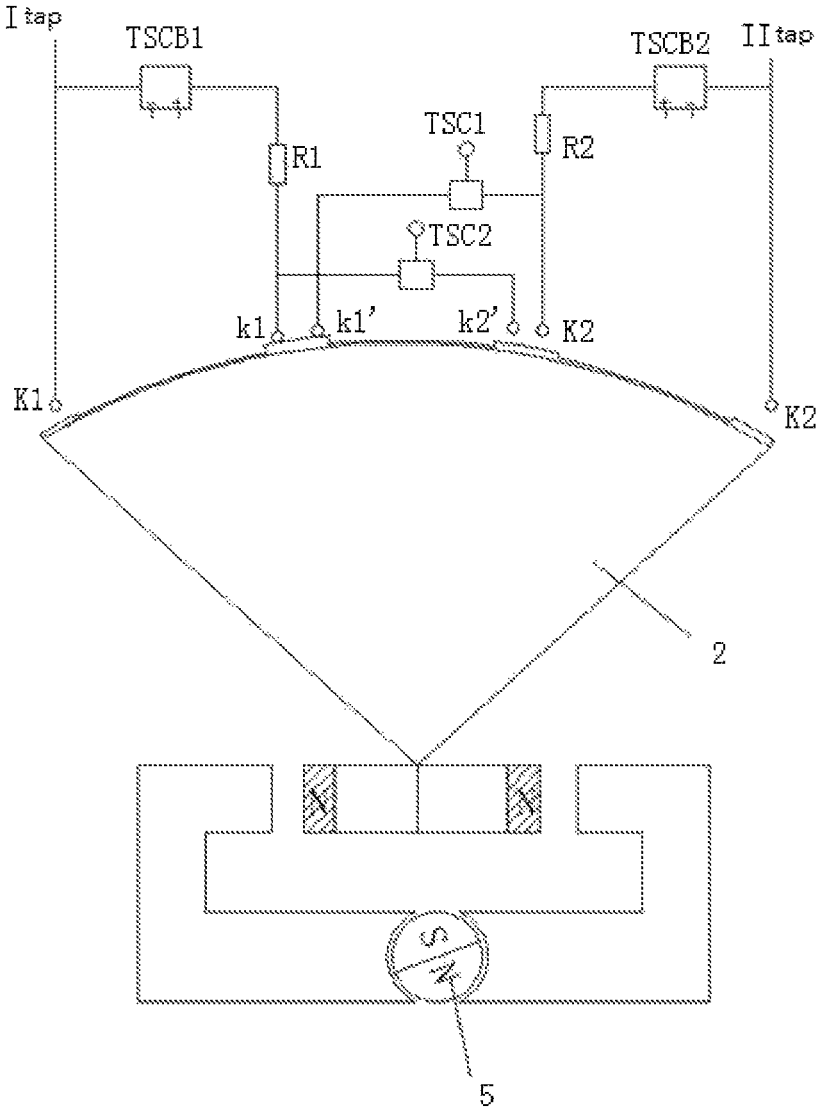
FIG. 5 is the schematic diagram of contacting of the moving contactor with the dual-contact synchronous transition contactor k1, k1' in Embodiment 1.
Figure 6:
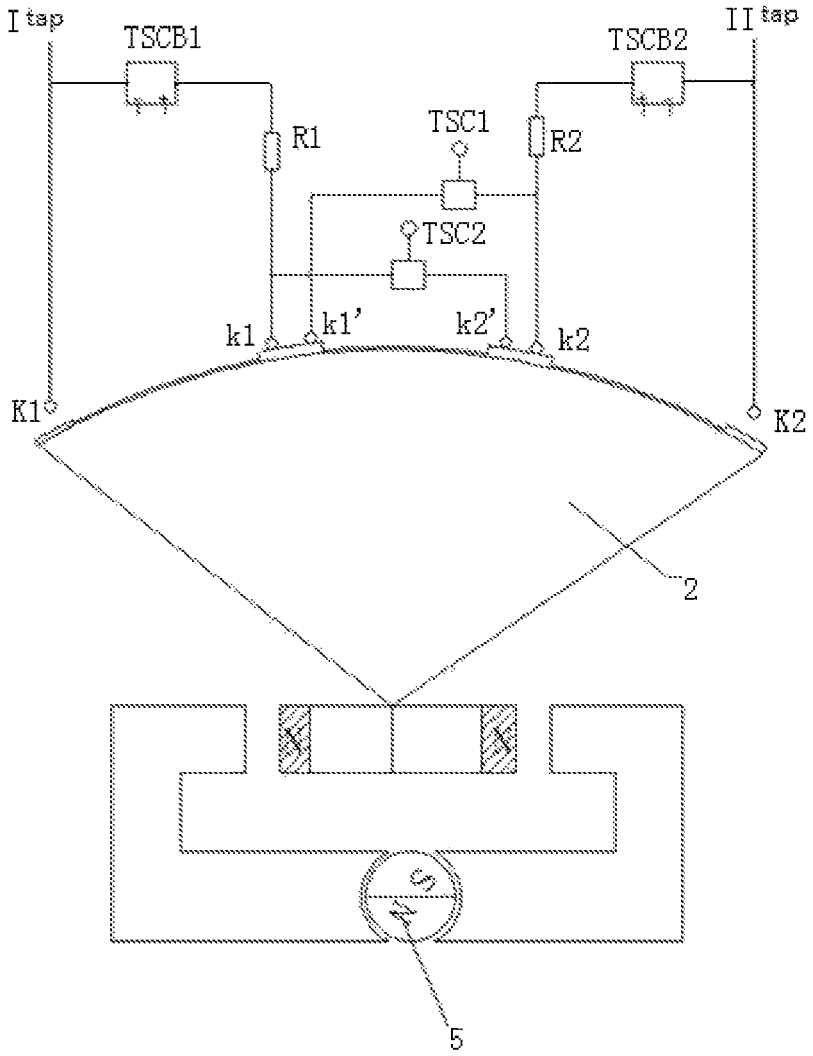
FIG. 6 is the schematic diagram of contacting of the moving contactor with the dual-contact synchronous transition contactor k1, k1' and dual-contact synchronous transition contactor k2, k2' in Embodiment 1.
Figure 7:
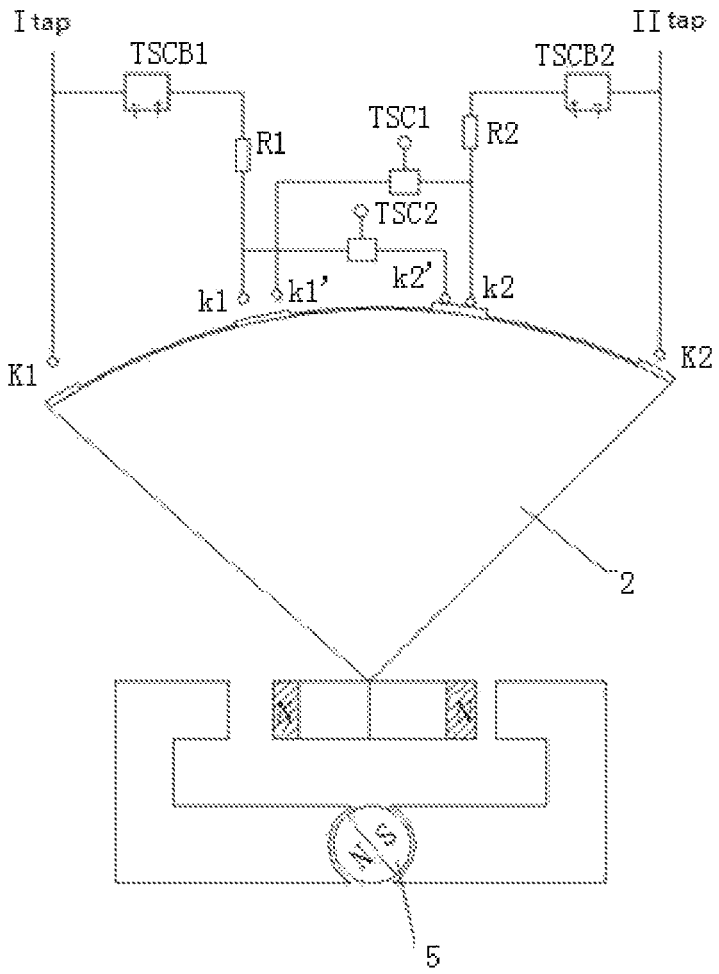
FIG. 7 is the schematic diagram of contacting of the moving contactor with dual-contact synchronous transition contactor k2, k2' in Embodiment 1.
Figure 8:
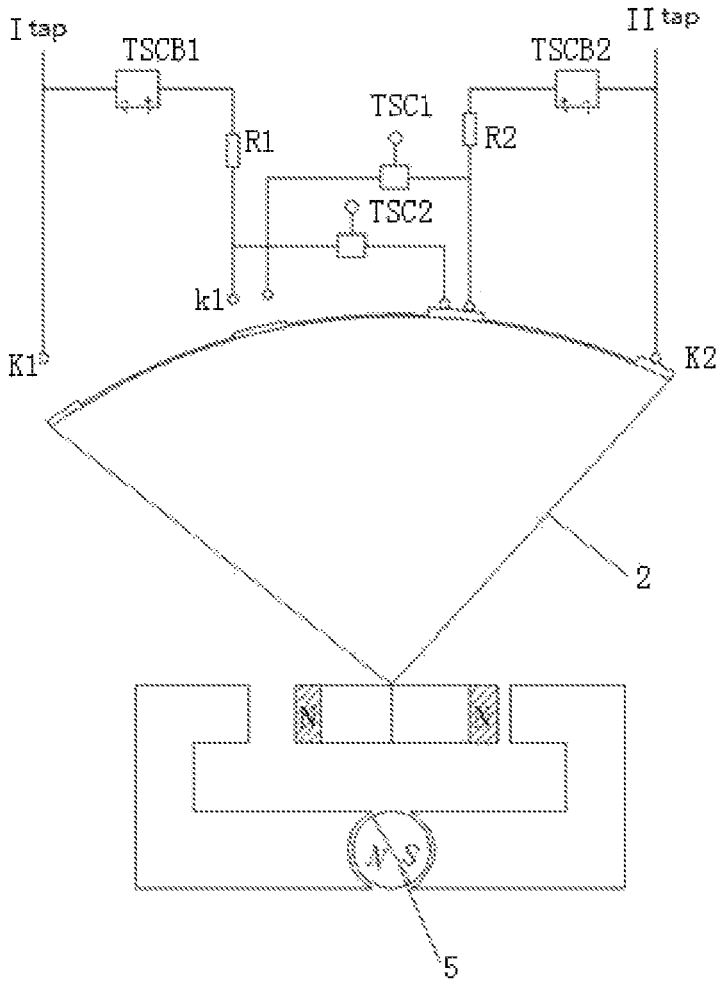
FIG. 8 is the schematic diagram of contacting of the moving contactor with the working contactor K2 and dual-contact synchronous transition contactor k2, k2' in Embodiment 1.
Figure 9:
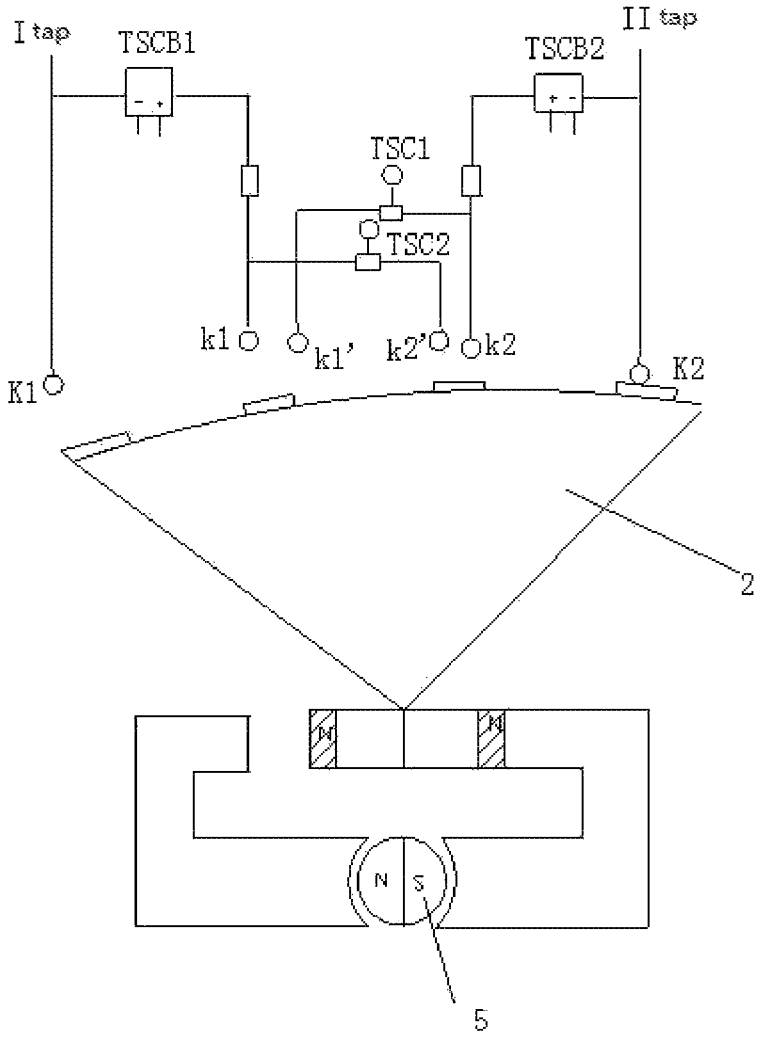
FIG. 9 is the schematic diagram of contacting of the moving contactor with the working contactor K2 in Embodiment 1.

As shown in FIG. 3 to FIG. 9, the process that the moving contactor 7 switches from the working contactor K1 to the working contactor K2 is as follows:

As shown in FIG. 3, the moving contactor 7 contacts with the working contactor K1, while the trigger transmitter TSCB1 and the trigger transmitter TSCB2 have no current;

As shown in FIG. 4, the moving contactor 7 contacts with the working contactor K1, the dual-contact synchronous transition contactors k1, k1', while the trigger transmitter TSCB1 and the trigger transmitter TSCB2 have no current;

As shown in FIG. 5, the moving contactor 7 contacts with the dual-contact synchronous transition contactors k1, k1', while the trigger transmitter TSCB1 and the trigger transmitter TSCB2 have current;

As shown in FIG. 6, the moving contactor 7 contacts with the dual-contact synchronous transition contactors k1, k1' and the dual-contact synchronous transition contactors k2, k2', while the trigger transmitter TSCB1 and the trigger transmitter TSCB2 have current, and they are liable to produce electric arcs;

As shown in FIG. 7, the moving contactor 7 contacts with the dual-contact synchronous transition contactors k2, k2', while the trigger transmitter TSCB1 and the trigger transmitter TSCB2 have current;

As shown in FIG. 8, the moving contactor 7 contacts with the working contactor K2, the dual-contact synchronous transition contactors k2, k2', while the trigger transmitter TSCB1 and the trigger transmitter TSCB2 have no current;

As shown in FIG. 9, the moving contactor 7 contacts with the working contactor K2, while the trigger transmitter TSCB1 and the trigger transmitter TSCB2 have no current.

The normal work can be guaranteed even in the event of no timely overhaul when the following failures occur:

(1) When the high-voltage thyristor TSC1 is open-circuit, the working contactor K1 and the working contactor K2 will have striking of arc and extinction of arc;

(2) When the high-voltage thyristor TSC2 is open-circuit, the working contactor K1 and the working contactor K2 will have striking of arc and extinction of arc;

(3) When the high-voltage thyristor TSC1 is short-circuited turn-on, the dual-contact synchronous transition contactors k1, k1' will have striking of arc and extinction of arc;

(4) When the high-voltage thyristor TSC2 is short-circuited turn-on, the dual-contact synchronous transition contactors k2, k2' will have striking of arc and extinction of arc.

Embodiment 2

Figure 2:
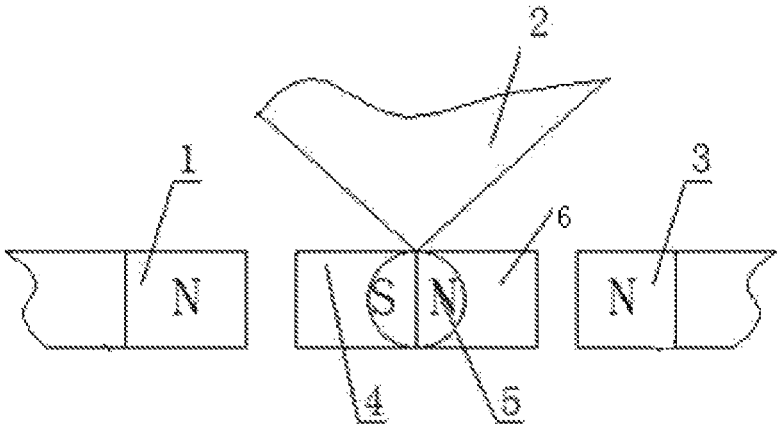
FIG. 2 is the structure diagram of high-speed mechanism in Embodiment 2.

A permanent magnet drive on-load tap-changing switch, as shown in FIG. 2, comprising a changing switch circuit and a high-speed mechanism, wherein the said changing switch circuit comprises an odd-numbered tap-changing circuit and an even-numbered tap-changing circuit that are structurally identical, wherein the tap-changing circuits are constituted by working contactors K1/K2, and dual-contact synchronous transition contactors k1, k1'/k2, k2' consisting of primary contactors k1/k2 and secondary contactors k1'/k2', and the working contactor K1/K2 is connected with the primary contactor k1/k2 by trigger transmitter TSCB1/TSCB2 and transition resistance R1/R2, the primary contactor k1 of the odd-numbered tap-changing circuit is connected to the secondary contactor k2' of the even-numbered tap-changing circuit by the high-voltage thyristor TSC2; the primary contactor k2 of even-numbered tap-changing circuit is connected to the secondary contactor k1' of the odd-numbered tap-changing circuit by the high-voltage thyristor TSC1. The said trigger transmitter TSCB1 provides the high-voltage thyristor TSC1 with trigger current; the said trigger transmitter TSCB2 provides the high-voltage thyristor TSC2 with trigger current. Wherein the said high-speed mechanism comprises a traveling mechanism 2 used for bearing a moving contactor 7, a moving magnet group connected with the traveling mechanism 2, and a fixed magnet group producing an attracting force/repelling force with respect to the moving magnet group; wherein the said moving magnet group comprises a rotating permanent magnet 5, a first magnetic conductor 4 and a second magnetic conductor 6 respectively set on both sides of the rotating permanent magnet 5, and the poles of the first magnetic conductor 4 and the second magnetic conductor 6 far from the rotating permanent magnet 5 are directly face to the fixed magnet group; wherein the said fixed magnet group comprises a first permanent magnet 1 and a second permanent magnet 3 respectively face to the first magnetic conductor 4 and the second magnetic conductor 6, and the poles of both permanent magnets near the magnetic conductor are homonymic magnetic poles. The said first magnetic conductor 4 and the said second magnetic conductor 6 are located between the first permanent magnet 1 and the second permanent magnet 3, and the four are parallel and level. In the Embodiment, the structure form of traveling mechanism 2 is not defined in any form as long as it can drive the moving contactor 7 to contact with or separate from the working contactors K1, K2 and the transition contactors k1, k2.

The process that the moving contactor 7 switches from the working contactor K1 to the working contactor K2 is the same as that of Embodiment 1.

The invention claimed is:

1. A permanent magnet drive on-load tap-changing switch, characterized in that: comprising a changing switch circuit and a high-speed mechanism, wherein the said changing switch circuit comprises an odd-numbered tap-changing circuit and an even-numbered tap-changing circuit that are structurally identical, wherein the tap-changing circuits are constituted by working contactors, and dual-contact synchronous transition contactors consisting of primary contactors and secondary contactors, and the working contactor is connected with the primary contactor by trigger transmitter and transition resistance, and a primary contactor of a tap-changing circuit is connected to the secondary contactor of another tap-changing circuit by a high-voltage thyristor, while the said trigger transmitter provides the high-voltage thyristor connected to the secondary contactor of the same tap-changing circuit with trigger current, wherein the said high-speed mechanism comprises a traveling mechanism used for bearing a moving contactor, a moving magnet group connected with the traveling mechanism, and a fixed magnet group producing an attracting force/repelling force with respect to the moving magnet group; wherein the said moving magnet group comprises a first permanent magnet and a second permanent magnet connected together at homonymic magnetic poles, an exposed homonymic magnetic pole of the first permanent magnet and that of the second permanent magnet face directly the fixed magnet group; wherein the said fixed magnet group comprises a rotating permanent magnet that rotates to change a force applied to the moving magnet group and thereby allowing the moving contactors to either come into contact with or be separated from working contactors and dual-contact synchronous transition contactors.

2. The permanent magnet drive on-load tap-changing switch according to claim 1, characterized in that wherein both sides of the said rotating permanent magnets are enveloped on the head poles of the first magnetic conductor and the second magnetic conductor, while the tail poles of the first magnetic conductor and the second magnetic conductor are respectively directly face to the first permanent magnet and the second permanent magnet.

3. The permanent magnet drive on-load tap-changing switch according to claim 2, characterized in that wherein the said first permanent magnet and the said second permanent magnet are located between the first magnetic conductor and the second magnetic conductor, and the four are parallel and level.

4. A permanent magnet drive on-load tap-changing switch, characterized in that: comprising a changing switch circuit and a high-speed mechanism, wherein the said changing switch circuit comprises an odd-numbered tap-changing circuit and an even-numbered tap-changing circuit that are structurally identical, wherein the tap-changing circuits are constituted by working contactors, and dual-contact synchronous transition contactors consisting of primary contactors and secondary contactors, and the working contactor is connected with the primary contactor by trigger transmitter and transition resistance, and a primary contactor of a tap-changing circuit is connected to the secondary contactor of another tap-changing circuit by a high-voltage thyristor, while the said trigger transmitter provides the high-voltage thyristor connected to the secondary contactor of the same tap-changing circuit with trigger current, wherein the said high-speed mechanism comprises a traveling mechanism used for bearing a moving contactor, a moving magnet group connected with the traveling mechanism, and a fixed magnet group producing an attracting force/repelling force with respect to the moving magnet group; wherein the said moving magnet group comprises a rotating permanent magnet, a first magnetic conductor and a second magnetic conductor respectively set on both sides of the rotating permanent magnet, and the poles of the first magnetic conductor and the second magnetic conductor far from the rotating permanent magnet are directly face to the fixed magnet group; wherein the said fixed magnet group comprises a first permanent magnet and a second permanent magnet respectively face to the first magnetic conductor and the second magnetic conductor, and the poles of both permanent magnets near the magnetic conductor are homonymic magnetic poles.

5. The permanent magnet drive on-load tap-changing switch according to claim 4, characterized in that wherein the said first magnetic conductor and the said second magnetic conductor are located between the first permanent magnet and the second permanent magnet, and the four are parallel and level.

* * * * *